US005403008A

United States Patent [19]

Mainiero

[11] Patent Number: 5,403,008

[45] Date of Patent: Apr. 4, 1995

[54] GOLF GRIP TRAINING AND EXERCISE DEVICE

[76] Inventor: Joseph Mainiero, 501 Lincoln Ave., Sayville, N.Y. 11782

[21] Appl. No.: 209,466

[22] Filed: Mar. 14, 1994

[51] Int. Cl.[6] ..... A63B 69/36; A63B 23/16

[52] U.S. Cl. ..... 273/187.2; 273/189 R; 482/49

[58] Field of Search ..... 482/49, 50; 273/81.4, 273/187.5, 187.2, 189 R

[56] References Cited

U.S. PATENT DOCUMENTS 2,962,288 11/1960 Lowden ..... 273/81.4 X
4,836,544 6/1989 Lai ..... 273/81.4 X
5,076,569 12/1991 Gooter ..... 482/49

*Primary Examiner*—George J. Marlo
*Attorney, Agent, or Firm*—Richard L. Miller

[57] ABSTRACT

A golf grip training and exercise device (10), comprising an elongate, one-piece body of oval transverse cross section including:

a) a major, front face (16) having a finger side (18), and a thumb side (20) opposite the finger side (18) and parallel thereto;

b) a top face (14) adjoining the front face (16);

c) a bottom face (12) adjoining the front face (16) and opposite the top face (14); and d) a major back face (30) extending between the top and bottom faces and joining the front face along the finger and thumb sides, the front face (16) being formed with three, hemi-cylindrical finger grooves (22) extending in generally parallel relation across a surface thereof from the finger side (18) at an oblique angle thereto toward the bottom face (12) for accommodating three fingers (53, 54, 55) of a person's hand, and a hemi-cylindrical thumb indentation (24) extending across a surface thereof in generally parallel relation to the finger grooves from the thumb side (20) toward the top face (14); and, the back face (30), forming a mirror image of the front face (16), and the finger grooves (22) and the thumb grooves (24) extending continuously around the finger side and the thumb side, respectively, from the front face (16) to the back (30).

5 Claims, 2 Drawing Sheets

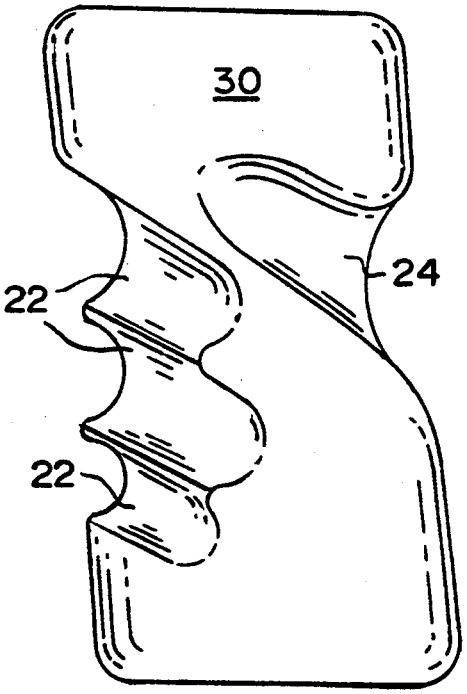
Fig. IA

GOLF GRIP TRAINING AND EXERCISE DEVICE

BACKGROUND OF THE INVENTION

The invention relates to a golf exerciser. More particularly, the invention relates to a device for training a person how to correctly grip a golf club.

A large component of successful golfing is correctly holding the club. Many golfers spend too much time playing golf, while never mastering the basics. These golfers could greatly improve their game by simply learning and practicing the proper way to grip the club.

Commercial golf practicing units allow golfers to practice putting or swinging in their homes or offices.

While these units may be suitable for the particular purpose employed, or for general use, they would not be as suitable for the purposes of the present invention as disclosed hereafter.

SUMMARY OF THE INVENTION

It is an object of the invention to produce a golf exerciser that trains a person how to correctly grip a golf club.

It is another object to produce a golf exerciser that tones specific hand and arm muscles used in the sport of golf.

It is yet another object to produce a golf exerciser that can be used on and off the golf course.

It is a further object to produce a golf exerciser that is economical to manufacture.

The invention is a golf exerciser, comprising a front face, a top face, and a bottom face. The front face has a finger side and a thumb side. The front face has three finger indentations extending from the finger side toward the bottom face, for accommodating three fingers from a person's hand. The front face has a thumb indentation extending from the thumb side toward the top face for accommodating a person's thumb. The golf exerciser also having a back face, forming a mirror image of the front face.

To the accomplishment of the above and related objects, the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like reference numerals depict like elements throughout the several views. The drawings are briefly described below.

FIG. 1A is an elevational view of a back side of the instant invention, representing a mirror image of FIG. 1.

DETAILED DESCRIPTION OF THE PREFERRED EMBODIMENTS

Figure 1:
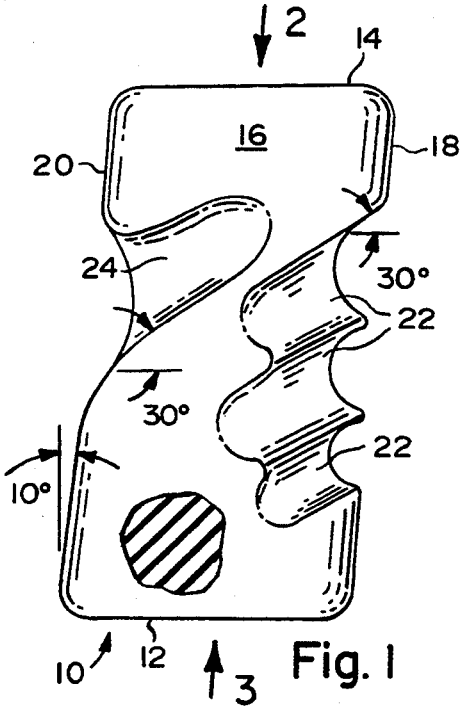
FIG. 1 is an elevational view of the instant invention, with a section torn away showing that the device is fabricated out of rubber.

FIG. 1 illustrates a golf exerciser 10. The golf exerciser is roughly the shape of a 6-sided volume. The golf exerciser 10 has a substantially flat bottom face 12, and a substantially flat top face 14 opposite the bottom face 12. The golf exerciser is pitched from the bottom face 12 to the top face 14 at approximately 10 degrees. As indicated by a portion removed in FIG. 1, the golf exerciser 10 may be formed from a single piece of rubber. The rubber construction allows further toning of hand and arm muscles by allowing a golfer to squeeze the golf exerciser 10. Although rubber is the material of choice plastic may also be suitable. The hardness of the rubber more than likely would be chosen in the range of 30 to 55 durometer although it is to be understood that this is not to be construed as a limiting range an other values might chosen either higher or lower.

The golf exerciser 10 has an almost flat front face 16. Boarding the front face are a curved surface finger side 18 and a curved surface thumb side 20.

Three finger indentations 22 comprise half cylindrical grooves parallel to the front face 16, that accommodate fingers from an average persons hand. The finger indentations 22 differ in length, to accommodate, from top to bottom, a middle finger, ring finger, and little or pinky finger of a person's hand. The finger indentations 22 extend from the finger side 18 toward the thumb side, at approximately a 30 degree angle toward the bottom face 12.

A thumb indentation 24 extends from the thumb side 20 up toward the top face 14 and toward the finger side 18 at approximately 30 degrees. The thumb indentation 24 is approximately parallel to the finger indentations 22. The thumb indentation 24 is a half cylindrical groove that runs parallel to the front face 16 and can accommodate a thumb from the hand of an average person.

FIG. 1A represents a back face 30 of the golf exerciser 32. The back face 30 is a mirror image of the front face 16. The finger indentations 22 on the back face 30 mirror the finger indentations 22 on the front face 16. In fact, the finger indentations 22 are each continuous, extending from the front face 16 to the back face.

Similarly, the thumb indentation 24 on the back face 30 mirrors the thumb indentation 24 on the front face 16. The thumb indentation 24 is continuous, extending from the front face 16 to back faced 30.

Figure 2:
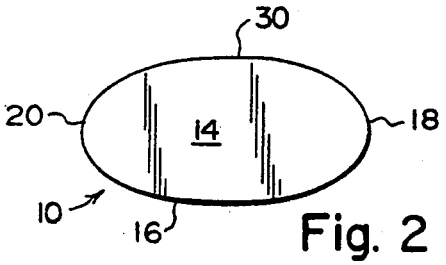
FIG. 2 is a top view taken in the direction of arrow 2 in FIG. 1.

FIG. 2 illustrates a view of the top face 14 of the golf exerciser 10 as indicated by arrow 2 in FIG. 1.

Figure 3:
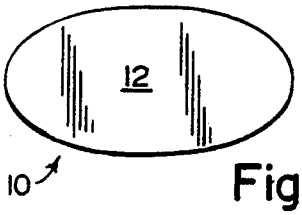
FIG. 3 is a bottom view taken in the direction of arrow 3 in FIG. 1.

FIG. 3 illustrates a view of the bottom face 12 of the golf exerciser 10 as indicated by arrow 3 in FIG. 2.

Noted from FIG. 2 and FIG. 3 is that the finger indentations 22 and thumb indentations 24 on the front face 16 and back face 30 are not visible when the golf exerciser is viewed from the top face 14 or bottom face 12 in the directions indicated in FIG. 1.

FIG. 4–7 illustrate how a right handed person would use the golf exerciser 10.

The person has a right hand 40, having a thumb 41, an index finger 42, a middle finger 43, a ring finger 44, and a pinky 45.

The person has a left hand 50, having a thumb 51, an index finger 52, a middle finger 53, a ring finger 54, and a pinky 55.

Figure 4:
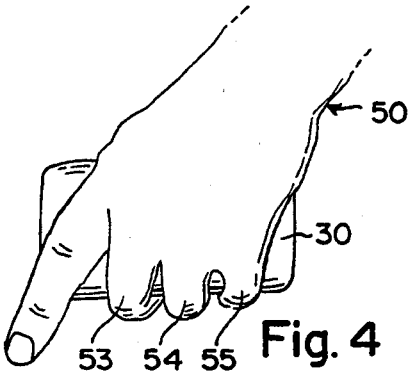
FIG. 4 is a back side view of the left hand of a right handed golfer grasping the instant invention.
Figure 5:
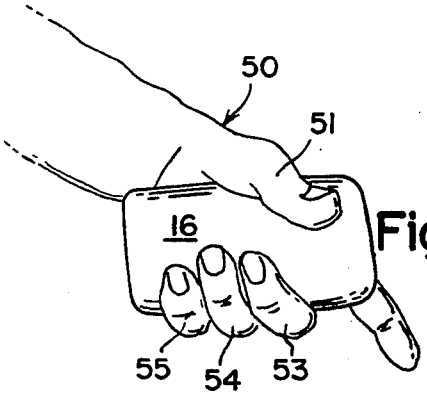
FIG. 5 is a palm side view of the left hand of a right handed golfer grasping the instant invention.

FIG. 4 and FIG. 5 illustrate a left hand 50 gripping the golf exerciser.

FIG. 4 is a back side view of the left hand 50. The middle finger 53, ring finger 54, and pinky 55 of the left hand 50 wrap around the finger indentations on the back face 30 toward the front face.

FIG. 5 is a palm side view of the left hand 50. The middle finger 53, ring finger 54, and pinky 55 rest in the finger indentations 22 on the front face 16. The thumb 51 rests in the thumb indentation 24 on the front face.

Figure 6:
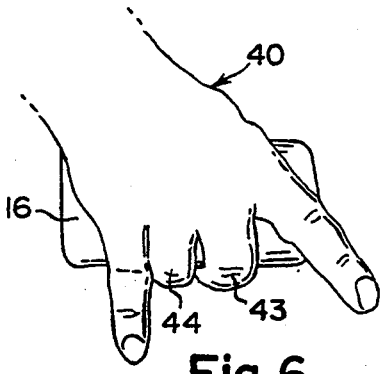
FIG. 6 is a back side view of the right hand of a right handed golfer grasping the instant invention.
Figure 7:
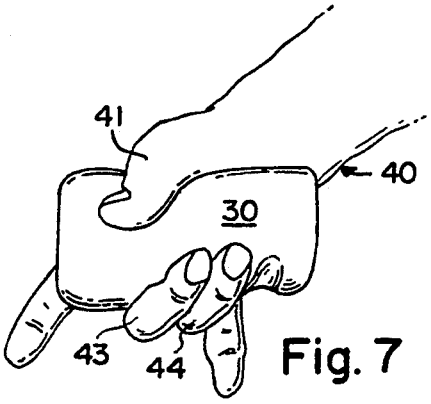
FIG. 7 is a palm side view of the right hand of a right handed golfer grasping the instant invention.

FIG. 6 and FIG. 7 illustrate a right hand 40 gripping the golf exerciser.

FIG. 6 is a back side view of the right hand 40. The middle finger 43 and ring finger 44 of the right hand 40 wrap around the finger indentations on the front face 16 toward the back face.

FIG. 7 is a palm side view of the right hand 40. The middle finger 43 and ring finger 44 of the right hand 40 rest in the finger indentations of the back face 30. The thumb 41 of the right hand 40 rests in the thumb indentation of the back face 30.

Illustrated in FIG. 4–7 is how a right handed golfer would grip the golf exerciser 10. However, the golf exerciser 10 is equally as suitable for use by a left handed golfer. For a left handed golfer all of the views of illustrated in FIG. 4–7 are exactly mirror images of those illustrated.

What is claimed is:

1. A golf grip training and exercise device (10), comprising an elongate, one-piece body of oval transverse cross-section including:

a) a major, front face (16) having a finger side (18), and a thumb side (20) opposite the finger side (18) and parallel thereto;

b) a top face (14) adjoining the front face (16);

c) a bottom face (12) adjoining the front face (16) and opposite the top face (14); and d) a major, back face (30) extending between the top and bottom faces and joining the front face along the finger and thumb sides, the front face (16) being formed with three, hemi-cylindrical finger grooves (22) extending in generally parallel relation across a surface thereof from the finger side (18) at an angle of substantially thirty degrees therewith toward the bottom face (12) for accommodating three fingers (53,54,55) of a person's hand, and a hemi-cylindrical thumb groove (24) extending across a surface thereof in generally parallel relation to the finger grooves from the thumb side (20) toward the top face (14); and the major back face, forming a mirror image of the front face (16), and the finger grooves (22) and the thumb grooves (24) extending continuously around the finger side and the thumb side, respectively, from the front face (16) to the back face (30).

2. The apparatus as recited in claim 1, wherein the top face and bottom face are parallel and the thumb side extends at an inclination of approximately 10 degrees to the bottom face.

3. The apparatus as recited in claim 1, wherein the body is constructed of rubber.

4. The apparatus as recited in claim 1, wherein the body is constructed of plastic.

5. A golf grip training and exercise device (10), comprising an elongate, one-piece body of oval transverse cross section including:

a) a major, front face (16) having a finger side (18), and a thumb side (20) opposite the finger side (18) and parallel thereto;

b) a top face (14) adjoining the front face (16);

c) a bottom face (12) adjoining the front face (16) and opposite the top face (14); and d) a major back face (30) extending between the top and bottom faces and joining the front face along the finger and thumb sides, the front face (16) being formed with three, hemi-cylindrical finger grooves (22) extending in generally parallel relation across a surface thereof from the finger side (18) at an oblique angle thereto toward the bottom face (12) for accommodating three fingers (53,54,55) of a person's hand, and a hemi-cylindrical thumb indentation (24) extending across a surface thereof in generally parallel relation to the finger grooves from the thumb side (20) toward the top face (14); and, the back face (30), forming a mirror image of the front face (16), and the finger grooves (22) and the thumb grooves (24) extending continuously around the finger side and the thumb side, respectively, from the front face (16) to the back face (30).

* * * * *